US011149367B2

(12) United States Patent
Harms et al.

(10) Patent No.: US 11,149,367 B2
(45) Date of Patent: Oct. 19, 2021

(54) REGENERATED CELLULOSE FIBER

(71) Applicant: KELHEIM FIBRES GMBH, Kelheim (DE)

(72) Inventors: Haio Harms, Gmunden (AU); Ingo Bernt, Regensburg (DE); Walter Roggenstein, Bad Abbach (DE)

(73) Assignee: KELHEIM FIBRES GMBH, Kelheim (DE)

( * ) Notice: Subject to any disclaimer, the term of this patent is extended or adjusted under 35 U.S.C. 154(b) by 946 days.

(21) Appl. No.: 14/359,781

(22) PCT Filed: Nov. 12, 2012

(86) PCT No.: PCT/EP2012/072387

§ 371 (c)(1),
(2) Date: May 21, 2014

(87) PCT Pub. No.: WO2013/079305

PCT Pub. Date: Jun. 6, 2013

(65) Prior Publication Data

US 2014/0308870 A1 Oct. 16, 2014

(30) Foreign Application Priority Data

Nov. 29, 2011 (EP) ..... 1191093

(51) Int. Cl.
*D01F 2/08* (2006.01)
*D01F 1/00* (2006.01)
(Continued)

(52) U.S. Cl.
CPC ..... *D04H 3/015* (2013.01); *D01D 5/253* (2013.01); *D01F 1/00* (2013.01); *D01F 2/08* (2013.01);
(Continued)

(58) Field of Classification Search
CPC ..... D04H 3/018; D04H 1/4258; D04H 3/013; D04H 1/3491; D01D 5/253; Y10T 442/611; Y10T 428/2973
(Continued)

(56) References Cited

U.S. PATENT DOCUMENTS 2,506,046 A * 5/1950 Steinlin ..... D06M 11/40 8/115
3,113,828 A * 12/1963 Geiger ..... D01F 2/10 264/189
(Continued)

FOREIGN PATENT DOCUMENTS

DE 41 397 A1 9/1965
DE 1 254 955 B 11/1967
(Continued)

OTHER PUBLICATIONS

Marsano et al., International Journal of Biological Macromolecules 43 (2008) pp. 106-114 (Marsano) (Year: 2008).*
(Continued)

*Primary Examiner* — Jennifer A Gillett
(74) *Attorney, Agent, or Firm* — Venable LLP

(57) ABSTRACT

The invention relates to a regenerated cellulose fiber in the form of a solid viscose flat fiber having the following properties:

The fiber consists of cellulose by more than 98%.
The ratio of width B to thickness D of the fiber is 10:1 or higher.
The fiber surface is essentially smooth.
The fiber is essentially transparent.

The fiber according to the invention is particularly suitable for the production of paper.

6 Claims, 3 Drawing Sheets

(51) Int. Cl.

| | |
|---|---|
| ***D04H 3/015*** | (2012.01) |
| ***D21H 13/08*** | (2006.01) |
| ***D01D 5/253*** | (2006.01) |
| ***D21H 15/02*** | (2006.01) |
| ***D04H 1/4258*** | (2012.01) |
| ***D04H 3/013*** | (2012.01) |
| ***D04H 3/018*** | (2012.01) |
| ***D04H 1/4391*** | (2012.01) |

(52) U.S. Cl.
CPC ..... *D04H 1/4258* (2013.01); *D04H 1/43912* (2020.05); *D04H 3/013* (2013.01); *D04H 3/018* (2013.01); *D21H 13/08* (2013.01); *D21H 15/02* (2013.01); *Y10T 428/2973* (2015.01); *Y10T 442/611* (2015.04)

(58) Field of Classification Search
USPC ..... 442/334
See application file for complete search history.

(56) References Cited

U.S. PATENT DOCUMENTS

| | | | | |
|---|---|---|---|---|
| 3,156,605 | A * | 11/1964 | Anderer | D01D 5/24 139/420 R |
| 3,318,990 | A | 5/1967 | Kajitani | |
| 3,418,405 | A * | 12/1968 | Kajitani | D01F 2/10 264/190 |
| 3,565,652 | A | 2/1971 | Burnet et al. | |
| 4,569,343 | A * | 2/1986 | Kimura | A61F 13/00063 424/447 |
| 5,047,197 | A * | 9/1991 | Uneback | D01F 2/08 106/166.52 |
| 7,258,764 | B2 * | 8/2007 | Mauler | D21H 23/765 162/141 |
| 2006/0200103 | A1 * | 9/2006 | Schmidtbauer | A61L 15/28 604/358 |

FOREIGN PATENT DOCUMENTS

| | | | | |
|---|---|---|---|---|
| DE | 14 94 762 | B1 | 4/1970 | |
| DE | 230 030 | A1 | 11/1985 | |
| EP | 2280099 | A1 * | 2/2011 | D01D 5/253 |
| GB | 945 306 | A | 12/1963 | |
| GB | 1 063 217 | A | 3/1967 | |
| GB | 1 064 475 | A | 4/1967 | |
| GB | 1063217 | * | 4/1967 | |
| WO | 20060134132 | A1 | 12/2006 | |
| WO | 20100071906 | A1 | 7/2010 | |
| WO | 20110012423 | A1 | 2/2011 | |

OTHER PUBLICATIONS

Textile Innovation Knowledge Platform, Dry-Jet Wet Spinning, http://www.tikp.co.uk/knowledge/technology/fibre-and-filament-production/dry-jet-wet-spinning/, (Year: 2018).*
Collier et al., Understanding Textiles (2001), Prentice-Hall, Inc., Upper Saddle River, NJ, (Year: 2001).*
EP 2280099 English Machine Translation, espacenet, retrieved Oct. 29, 2019.*
Woodings, C.R. et al., "The manufacture properties and uses of inflated viscose rayon fibres", TAPPI Nonwovens Symposium; (1985) pp. 155-166.
Presentation held by Mr. Bernt at the 51st "Chemiefasertagung" in Dornbirn, Austria, Sep. 20, 2012 (24 pages).
Notification of Transmittal of Translation of the International Preliminary Report on Patentability and Written Opinion issued in International Application No. PCT/EP2012/072387 dated Jun. 12, 2014—9 pages.
K. Bredereck and F. Hermanutz, "Man-made cellulosics," Rev. Prog. Color, 35, pp. 59-75 (2005).
Schuster et al., "Characterising the Emerging Lyocell Fibres Structures by Ultra Small Angle Neutron Scattering (USANS)", Lenzinger Berichte, 82, pp. 107-117 (2003).
Heinze (ed.), et al., "Structure and Properties of Cellulose", Macromolecular Symposia, 262, pp. 39-64 (2008).
Roder et al., "Man-Made Cellulose Fibres—a Comparison Based on Morphology and Mechanical Properties," Lenzinger Berichte, 91, pp. 7-12 (2013).

* cited by examiner

REGENERATED CELLULOSE FIBER

BACKGROUND OF THE INVENTION

Field of the Invention

The present invention relates to a regenerated cellulose fiber in the form of a solid viscose flat fiber.

Flat Fibers and their manufacture are known. In contrast to the cross-section of fibers which commonly is essentially round, flat fibers have an essentially flat or, respectively, oblong cross-section.

On the one hand, cellulosic flat fibers can be produced by spinning a cellulose or a spinning dope containing a cellulose derivative through slot-shaped spinnerets. In case of viscose fibers, flat fibers can alternatively be produced in the form of collapsed hollow fibers. In doing so, a gas, e.g. nitrogen, or a blowing agent, e.g., sodium carbonate, is admixed to the spinning viscose. During the spinning of the fibers through dies, which are per se conventional, hollow fibers are formed whose walls, however, are so thin when appropriate process conditions are chosen that the Fibers will collapse and will then be provided in the form of flat fibers.

The article by C. R. Woodings, A. J. Bartholomew; "*The manufacture properties and uses of inflated viscose rayon Fibers*"; TAPPI Nonwovens Symposium; 1985; pp. 155-165.

Source: http://www.nonwoven.co.uk/publications_cat4.php, describes different types of hollow fibers and their uses.

WO 2006/134132 describes the use of viscose flat fibers in a fiber composite for the purpose of improving the dissolubility of the fiber composite in water. According to WO 2006/134132, the flat fibers used preferably have a crenelated (pinnacle-type) surface and, in contrast to collapsed hollow fibers, are produced by being spun through a slot die.

The manufacture of cellulosic flat fibers is known, for example, from GB 945,306 A, U.S. Pat. Nos. 3,156,605 A, 3,318,990, GB 1,063,217 A. Such fibers have been recommended especially for use in paper production, as is described in part in the above-mentioned documents.

DE 1 254 955 as well as GB 1,064,475 deal with paper produced from viscose fibers having flat cross-sections.

In these documents, it is thereby described as desirable that the fibers exhibit high transparency so that the paper produced from the fibers is transparent as well.

Regarding the production of flat viscose fibers, DE 1 254 955 describes five distinct variants. However, as to the production of a transparent fiber, only one exemplary embodiment is disclosed concretely. In this example, a high-molecular substance swelling in water, namely polyvinyl alcohol (PVA), is admixed to the viscose spinning dope. Sodium carbonate is also added to the spinning dope. The resulting fiber is thus a collapsed hollow fiber which contains a certain amount of PVA.

It is the object of the present invention to provide a viscose flat fiber which exhibits high transparency and is particularly suitable for the production of paper.

The object of the present invention is achieved by a regenerated cellulose fiber in the form of a solid viscose flat fiber having the following properties:

The fiber consists of cellulose by more than 98%.

The ratio of width B to thickness D of the fiber is 10:1 or higher.

The fiber surface is essentially smooth.

The fiber is essentially transparent.

Furthermore, the invention relates to a fiber bundle containing the cellulose fiber according to the invention, a method of producing the cellulose fiber according to the invention and the fiber bundle, respectively, as well as the use of the cellulose fiber according to the invention and of the fiber bundle, respectively, for the production of nonwoven fabrics and paper.

In a further aspect, the present invention relates to a paper containing the cellulose fiber according to the invention.

SHORT DESCRIPTION OF THE FIGURES

DETAILED DESCRIPTION OF THE INVENTION

The present invention relates to a solid viscose flat fiber having high transparency.

For the purposes of the present invention, solid "is understood to relate to a cellulose fiber which does not have a hollow or collapsed structure. In particular, the solid cellulose fiber according to the present invention exhibits no hollow spaces and no separating line resulting, for example, from the collapse of a hollow fiber.

Surprisingly, it has been found that it is possible to produce viscose flat fibers having high transparency which are solid and do not contain a noteworthy amount of swelling high-molecular substances.

Preferably, the fiber according to the invention consists essentially completely of cellulose. Essentially "is thereby understood to mean that, apart from conventional processing aids which are included in the final product within the scope of the viscose process, such as, e.g., finishing, no further components, in particular no high-molecular substances swelling in water, are included. A finishing overlay typically accounts for 0.1% and not more than 0.3%.

The surface of the flat fiber according to the invention is essentially smooth. The surface "is thereby understood to be the two faces which define the fiber's broadside.

Figure 5:
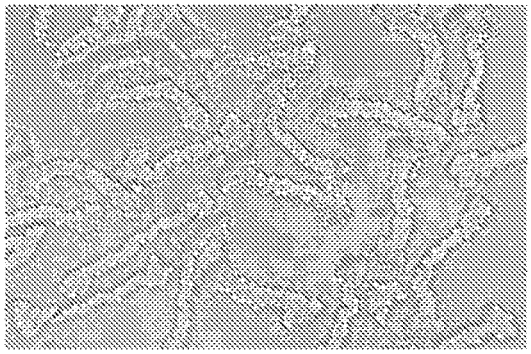
FIGURE 5 PRIOR ART
FIG. 5 shows cross-sections of fibers according to a reference example.
Figure 9:
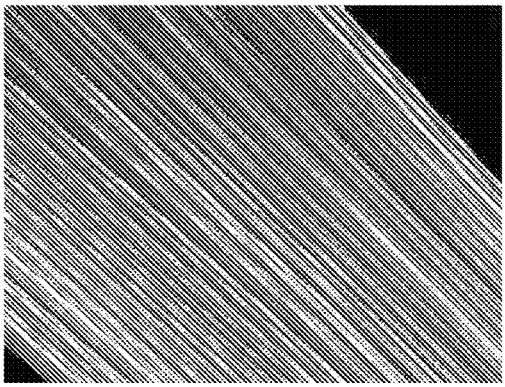
FIGURE 9 PRIOR ART
FIG. 9 shows a scanning electron micrograph of the surface of a fiber according to a reference example.

Essentially smooth "is understood to mean in particular that the fiber, apart from its edge regions, features essentially no grooves in the longitudinal direction which have a groove thickness of more than 10%, in particular more than 5%, of the fiber thickness. Grooves "are thereby understood to be indentations in the longitudinal direction which are small relative to the width of the fiber and are typical for standard viscose fibers, as is apparent, for example, from FIGS. 5 and 9.

Due to the shrinking processes which are typical for viscose fibers, the presence of a relatively deep groove or arching, respectively, in the edge regions of the fiber is in most cases not preventable.

The two faces of the fiber which define the fiber's broadside are preferably parallel to each other across an area of at least 90% of the fiber surface.

Preferably, the ratio of width B to thickness D of the fiber according to the invention is 20:1 or higher.

The titer of the fiber according to the invention can range from 2 to 40 dtex, in particular from 2 to 28 dtex.

Preferably, the fiber can be provided as a short-cut fiber with a length of cut ranging from 2 to 20 mm, particularly preferably from 3 to 12 mm. In particular for the application in nonwoven fabrics and textiles, the fiber may also be provided as a staple fiber with lengths of cut ranging from 30 mm to 150 mm, in particular from 40 to 110 mm, particularly preferably of 40 mm (cotton type) and 70 mm (wool type).

In a further preferred embodiment of the present invention, the fiber according to the invention can be modified anionically.

It has been found that anionic modification of the fiber increases the strength of papers produced therefrom.

Preferably, the anionic modification of the fiber is achieved in that carboxymethyl cellulose (CMC) is incorporated in the fiber. The incorporation of CMC in viscose fibers is described, inter alia, in WO 2011/12423A.

The present invention also relates to a fiber bundle containing a plurality of cellulose fibers according to the invention.

A "Fiber bundle" is understood to be a plurality of fibers such as, e.g., artificial cell-wool (a plurality of staple fibers), a strand of continuous filaments or a bale of fibers.

In the fiber bundle according to the invention, the cross-sections of the cellulose fibers contained therein are preferably essentially the same.

The method of producing a cellulose fiber according to the invention and, respectively, a fiber bundle according to the invention comprises the following steps:

providing a viscose spinning dope, spinning the viscose spinning dope through at least one slot-shaped opening of a spinneret into a spinning bath, with spun filaments being formed, wherein the viscose spinning dope contains a coagulation retarder, in particular polyethylene glycol, the ratio of length to width of the die slot is 10:1-30:1, preferably 15:1-25:1, the spinning bath exhibits an amount of $H_2SO4$ of 110-140 g/L, preferably 120-130 g/L, the spun filaments are drawn off with a die draft of 2.0-3.0, after leaving the spinning bath, the spun filaments are stretched at a ratio of 20%-35%, preferably 25-35%.

Surprisingly, it has been found that solid viscose flat fibers with excellent transparency can be produced by combining these process measures.

By adding a coagulation retarder (in particular PEG), a delayed coagulation of the viscose spinning dope in the spinning bath is effected. In this way, the period for the diffusion of the liquid out of the fiber is prolonged and the formation of a smooth surface is rendered possible. Likewise, the time during which gas bubbles can diffuse out of the fiber is thus prolonged.

Preferably, the viscose contains the coagulation retarder, in particular PEG, in an amount ranging from 1 to 6% by weight, preferably from 1 to 5% by weight, particularly preferably from 3 to 5% by weight, in particular from 3 to 4% by weight, based on cellulose.

However, the addition of a coagulation retarder also has the effect that the spun fiber has more time for reducing its surface area due to its surface tension. In the normal case, this causes the fiber to approach more and more the round shape.

According to the invention, this effect is counteracted in various ways:

The spun filaments are spun into a spinning bath with a relatively high acid concentration ($H_2SO_4$). This supports the coagulation of the fiber from outside and thus causes a fixation of the geometry. The remaining components of the spinning bath, such as, e.g., $Na_2SO_4$ and $ZnSO_4$, can be contained at concentrations which are common for the viscose process.

The fibers are spun out with an increased draft and relatively high stretching (wherein stretching can be performed in one or several steps, but preferably at least the greater part of stretching is performed in an early stage of the procedure, e.g., immediately after leaving the spinning bath). By these measures, a relaxation of the structure and hence a deviation from the flat shape are aggravated.

The remaining processing parameters can be kept in ranges which are common for the viscose process. With regard to the spinning bath composition, a person skilled in the art will regard a content of sodium sulfate of 250-400 g/l and a content of zinc sulfate of 5-20 g/l as common A typical standard spinning viscose has a content of cellulose of 8-10% by weight and a content of NaOH of 5-9% by weight.

The processing parameters according to the invention cause the fiber to shrink preferably in the direction of its thickness (y-direction), whereby very thin fibers with a very high ratio of width to thickness and thus a large surface area, which is particularly desirable for paper production, are formed.

Accordingly, the fibers according to the invention are perfectly suitable for use in papers, in particular in transparent papers.

It has been found that a laboratory sheet of 80 grams (Rapid-Köthen, DIN EN ISO 5269-2), made by 100% of a fiber according to the invention which has been cut to 6 mm, can have a breaking length (DIN EN ISO 1924-2) of at least 750 m.

For the application in the production of paper, the length of the fiber according to the invention preferably amounts to 3-12 mm.

However, the fibers according to the invention are also perfectly suitable for the production of nonwoven fabrics, e.g., hydro-entangled nonwoven fabrics or needled nonwoven fabrics.

EXAMPLES

Example 1

Viscose was spun through a spinneret having slot-shaped openings with a length of 1000 μm and a width of 60 μm and treated further as follows:

Drawing-off: 52 m/min, this corresponded to a die draft of 2.8

Stretching (after leaving the spinning bath): 30%

Viscose: standard spinning viscose, containing 4% by weight of polyethylene glycol (PEG) based on cellulose.

Spinning bath composition: 130 g/l $H_2SO_4$; remaining components in the usual range.

Aftertreatment: suspension, washing, aftertreatment, cut to 6 mm (short cut, wet)

Figure 1:
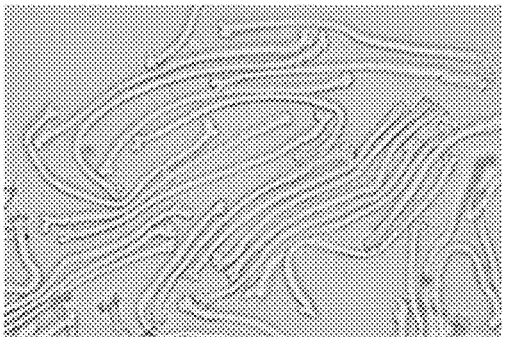
FIG. 1 shows cross-sections of fibers according to the invention.

Cross-sections of the fibers thus obtained are illustrated in FIG. 1.

The fiber cross-sections are very flat and thin. The two faces defining the fiber's broadside run parallel to each other virtually across the entire width of the fiber. Small protuberances are provided only at the fiber edge.

The width B of the fiber amounted to 230 μm, its thickness D was 6 μm. This results in a ratio B:D of 38:1 as well as a titer of 22 dtex.

Figure 2:
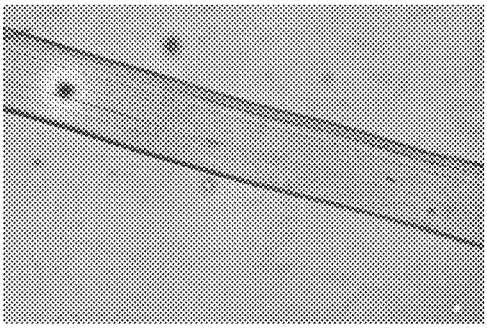
FIG. 2 shows a longitudinal view of a fiber according to the invention.

FIG. 2 shows a longitudinal view of the fiber. It can be seen clearly that the fiber is virtually completely transparent.

A Rapid-Köthen sheet of 80 grams, which has been produced without use of additives, made by 100% of the fiber according to the invention already exhibits a breaking length of 1000 m, which enables good handling of the sheet. So far, such strengths have been achieved in viscose fibers only with a hollow fiber process which requires vastly higher production expenditures.

Example 2

Viscose was spun through a spinneret having slot-shaped openings with a length of 700 μm and a width of 35 μm and treated further as follows:

Drawing-off: 52 m/min, this corresponded to a die draft of 2.8

Stretching (after leaving the spinning bath): 30%

Viscose: standard spinning viscose, containing 4% by weight of polyethylene glycol (PEG) based on cellulose.

Spinning bath composition: 130 g/l $H_2SO_4$; remaining components in the usual range.

Aftertreatment: suspension, washing, aftertreatment, cut to 6 mm (short cut, wet)

Figure 3:
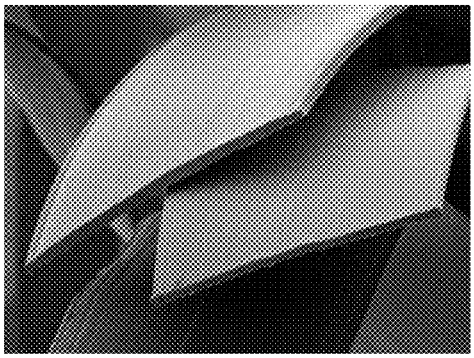
FIG. 3 shows a scanning electron micrograph of the surface of a fiber according to the invention.

FIG. 3 shows a scanning electron micrograph of the fiber cross-section of the Fibers obtained.

The fiber cross-sections are very flat and thin. The two faces defining the fiber's broadside run parallel to each other virtually across the entire width of the fiber. Small protuberances are provided only at the fiber edge.

The width B of the fiber amounted to 150 μm, its thickness D was 4 μm. This results in a ratio B:D of 38:1 as well as a titer of 9 dtex.

Figure 4:
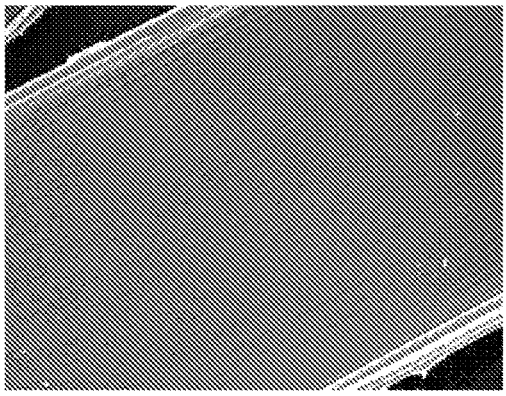
FIG. 4 shows a scanning electron micrograph of the cross-section of Fibers according to the invention.

FIG. 4 shows a scanning electron micrograph of the smooth surface of the fiber.

As can be seen from FIGS. 3 and 4, the fiber exhibits only at its edge in each case one clearly visible groove or arching, respectively.

A Rapid-Köthen sheet of 80 grams, which has been produced without use of additives, made by 100% of the fiber according to the invention already exhibits a breaking length of 2600 m, which enables a very good handling of the sheet.

Example 3

Viscose fibers were spun under conditions similar to those in Example 1, however, the spinning viscose did not contain PEG.

The fibers obtained exhibit (see FIG. 5) the jagged cross-section which is typical for solid viscose flat fibers produced in a conventional way, i.e., numerous grooves in the longitudinal direction, which cross-section impedes transparency of the fiber. In addition, fiber-fiber-bonds are not formed, either, which is also detrimental for the production of paper.

Example 4

Viscose fibers were spun under conditions similar to those in Example 1, however, the slot-shaped openings of the spinneret had a length of 140 μm and a width of 25 μm, i.e., a ratio of length to width of less than 10:1. Accordingly, the titer amounted to 2.1 dtex.

Figure 6:
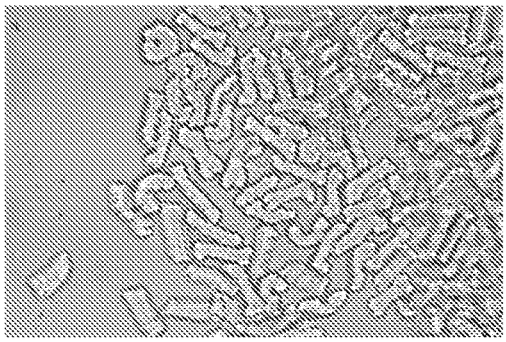
FIG. 6 shows cross-sections of fibers according to a further reference example.

The cross-sections of the fibers (see FIG. 6) show that, apart from the smaller ratio of width B to thickness D of these fibers, the cross-sections of the fibers are developed much less homogeneously. In parts, the fibers deviate from the flat shape and exhibit accurate cross-sections. Also as a result of the fact that the surface is not completely smooth and parallel, the fibers are thus predominantly non-transparent. Furthermore, the cross-section which is not completely flat renders the fiber unsuitable for the purpose of forming from it a sufficiently firm paper.

Example 5

Viscose fibers were spun under conditions similar to those in Example 1, however, the viscose spinning dope did not contain PEG and the spinning settings (draft, stretching, spinning bath composition) corresponded to those of a standard viscose process.

Figure 7:
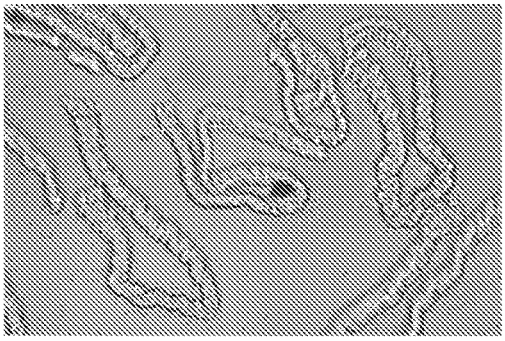
FIG. 7 shows cross-sections of fibers according to a further reference example.

Again, the Fibers (FIG. 7) exhibit a distinctly jagged cross-section.

Figure 8:
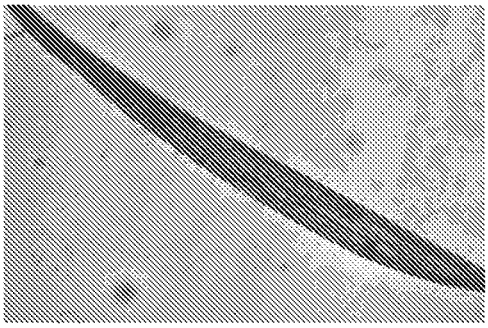
FIG. 8 shows the longitudinal view of a fiber according to a reference example.

The longitudinal view of the fiber (see FIG. 8) shows that the fiber is non-transparent. In the scanning electron micrograph of the surface (see FIG. 9), the grooves at the fiber surface are clearly visible.

What is claimed is:

1. A regenerated cellulose fiber in the form of a solid viscose flat fiber, wherein the fiber comprises the following properties:

the fiber comprises more than 98% cellulose;

the ratio of width B to thickness D of the fiber is 10:1 or higher;

the fiber surface is essentially smooth;

the fiber is transparent;

the fiber is a staple fiber with a length from 2 mm to 70 mm; and two faces of the fiber which define the fiber's broadside are parallel to each other across an area of at least 90% of a surface of the fiber.

2. The cellulose fiber according to claim 1, wherein the fiber comprises 99.7% to 99.9% cellulose.

3. The cellulose fiber according to claim 1, wherein the ratio of width B to thickness D of the fiber is 20:1 or higher.

4. The cellulose fiber according to claim 1, wherein the fiber is modified anionically.

5. The cellulose fiber according to claim 4, wherein the modification comprises incorporation of carboxymethyl cellulose (CMC).

6. The cellulose fiber according to claim 1, wherein the cellulose includes carboxymethyl cellulose (CMC).

* * * * *